United States Patent [19]

Higaki et al.

[11] Patent Number: 4,794,424

[45] Date of Patent: Dec. 27, 1988

[54] COPYING APPARATUS

[75] Inventors: Masahiro Higaki; Keiji Nakatani; Hirokazu Yamada, all of Osaka, Japan

[73] Assignee: Minolta Camera Kabushiki Kaisha, Osaka, Japan

[21] Appl. No.: 141,195

[22] Filed: Jan. 6, 1988

[30] Foreign Application Priority Data

Jan. 8, 1987 [JP] Japan ..... 62-2057

[51] Int. Cl.[4] ..... G03G 15/00

[52] U.S. Cl. ..... 355/14 R; 355/7

[58] Field of Search ..... 355/14 R, 7, 14 C, 3 R

[56] References Cited

U.S. PATENT DOCUMENTS

| | | | |
|---|---|---|---|
| 4,222,660 | 4/1980 | Furuichi et al. | 355/14 R |
| 4,543,643 | 3/1985 | Shibazaki et al. | 355/55 X |
| 4,582,417 | 11/1986 | Yagasaki et al. | 355/7 |
| 4,627,707 | 8/1986 | Tani et al. | 355/14 R |
| 4,653,899 | 7/1987 | Watanabe | 355/14 R |
| 4,655,580 | 4/1987 | Watanabe et al. | 355/7 |
| 4,679,927 | 7/1987 | Sogo et al. | 355/7 X |
| 4,687,317 | 8/1987 | Appel et al. | 355/7 |
| 4,701,044 | 10/1987 | Horiuchi et al. | 355/7 |
| 4,724,464 | 2/1988 | Umeda et al. | 355/7 X |
| 4,739,368 | 4/1988 | Lachut et al. | 355/7 X |

*Primary Examiner*—R. L. Moses

*Attorney, Agent, or Firm*—Burns, Doane, Swecker & Mathis

[57] ABSTRACT

A copying apparatus comprises an editor for imputting data for specifying a desired area of a document and designating an edit mode for the specified area, a memory for storing the data of the specified area and data of the designated edit mode, a copying machine for copying an image of an arbitrary area of the document on copy paper and generating an auto-clear signal after a lapse of a predetermined period, and control means for controlling the copying machine based on the data stored in the memory. Thus, when the auto-clear signal is outputted from the copying machine, only the designation of the edit mode in the editor is canceled and the data of the specified area and the edit mode are maintained in the memory.

3 Claims, 8 Drawing Sheets

INTERRUPTION
S170
COMMUNICATION WITH 1ST CPU
RETURN

START
S101
INITIALIZATION
S103
SET MAIN TIMER
S105
AUTO-CLEAR SIGNAL EXISTS?
S107
CANCEL END KEY
S109
TRANSMIT CANCEL OF END KEY
S111
INPUT, OUTPUT
S113
En FLAG = 1?
S115
IS COPY BEING DONE?
S117
XY INPUT EXISTS?
S119
n < 2?
S121
COORDINATE MEMORY
S123
n + 1
S125
ERASE SW?
S127
E FLAG ← 1
S129
TRIMMING SW?
S131
T FLAG ← 1
S133
END SW?
S135
En FLAG ← 1
S137
CLEAR SW?
YES
NO
A
B
C
D

COPYING APPARATUS

BACKGROUND OF THE INVENTION

1. Field of the Invention

The present invention relates to a copying apparatus and particularly to a copying apparatus having auto-clear means, including an editing input apparatus connected thereto.

2. Description of the Prior Art

Copying machines having auto-clear means have been proposed. Such a copying machine is reset to an initial state if any operation keys are not used for a predetermined period. For example, it is assumed that the number of copies is set to "5" by using ten keys. In this case, if a predetermined period has passed, the set number of copies of a copying machine is reset to an initial value "1".

On the other hand, there has been proposed an editing input apparatus to be connected with a copying machine. Information for performing editing copy operation of a copying machine can be easily inputted to such an editing input apparatus. For example, information such as an area to be edited or an edit mode can be easily inputted to such an editing input apparatus. The area to be edited is defined for example by coordinates. The edit mode includes a mode for erasure inside an edited area, a mode for erasure outside an edited area, and the like. A copying machine to which such an editing input apparatus is connected performs editing copy operation based on the editing copy information inputted by the editing input apparatus.

If a conventional copying machine having auto-clear means is connected with a conventional editing input apparatus, determination is only made as to whether an edit mode is set or not, based on a signal outputted from the editing input apparatus to the copying machine. Input of the above described editing copy information is not detected. Consequently, automatic clearing is effected irrespective of whether coordinates or the like are inputted or not. Since a standard copy mode is set in an initial state of the copying machine, when automatic clearing is effected, the already inputted editing copy information is all brought into a non-inputted state. As a result, the input of the above described editing copy information is canceled. Thus, the memory where the above described information has been stored is cleared.

However, input of editing copy information, particularly, coordinates, is a relatively troublesome operation. Accordingly, if the already input editing copy information is reset to a non-inputted state, this causes great inconvenience to the operator. On the other hand, such inconvenience may be dissolved by resetting a timer of the auto-clear means when any editing copy information is inputted in the editing input apparatus. However, in such a case, the number of signals to be transmitted is increased. In consequence, a control system in that case is complicated.

SUMMARY OF THE INVENTION

Therefore, a primary object of the present invention is to provide a copying apparatus in which input of editing copy information is not canceled contrary to the operator's will due to automatic clearing, without increasing signals to be transmitted.

The above described object of the present invention can be attained in the following manner. Storing means for storing editing copy information is provided in an editing input apparatus and when an auto-clear signal is inputted, only an edit mode is canceled and inputted editing copy information is stored in the storing means.

Briefly stated, a copying apparatus in accordance with the present invention comprises: input means for inputting data for specifying a desired area of a document, storing means for storing input data, copy means for copying an image of an arbitrary area of the document on copy paper, control means for controlling the copy means based on data stored in the storing means, mode designation means for designating a mode for operating the control means, data of the designated mode being stored in the storing means, auto-clear means for generating an auto-clear signal, and mode cancel means for canceling the mode designated by the mode designation means.

Since the copying apparatus in accordance with the present invention is thus constructed, input of editing copy information is not canceled contrary to the operator's will even if an auto-clear signal is detected.

In a preferred embodiment of the present invention, the copying apparatus comprises: an editor for inputting data for specifying a desired area of a document and designating an edit mode for the specified area; a memory for storing the input data on the specified area and the designated edit mode; a copying machine having a first central processing unit (hereinafter referred to as CPU) for copying an image of an arbitrary area of the document on copy paper and generating an auto-clear signal; and a second CPU for controlling the copying machine based on the data stored in the memory, whereby only the edit mode in the editor is canceled and the input data are maintained in the memory when the auto-clear signal is outputted from the copying machine.

Thus, since the input data on the edit mode and the specified area are stored in the memory, edition of the desired area can be effected repeatedly even after detection of the auto-clear signal.

These objects and other objects, features, aspects and advantages of the present invention will become more apparent from the following detailed description of the present invention when taken in conjunction with the accompanying drawings.

DESCRIPTION OF THE PREFERRED EMBODIMENTS

In the description of the present invention, the U.S. Pat. No. 4,543,643 issued Sept. 24, 1985, entitled "Copying Magnification Setting Device for an Electrophotographic Copying Apparatus", assigned to the assignee of the present invention is incorporated by reference.

In the following, an embodiment of the present invention will be described with reference to the drawings.

Figure 1:
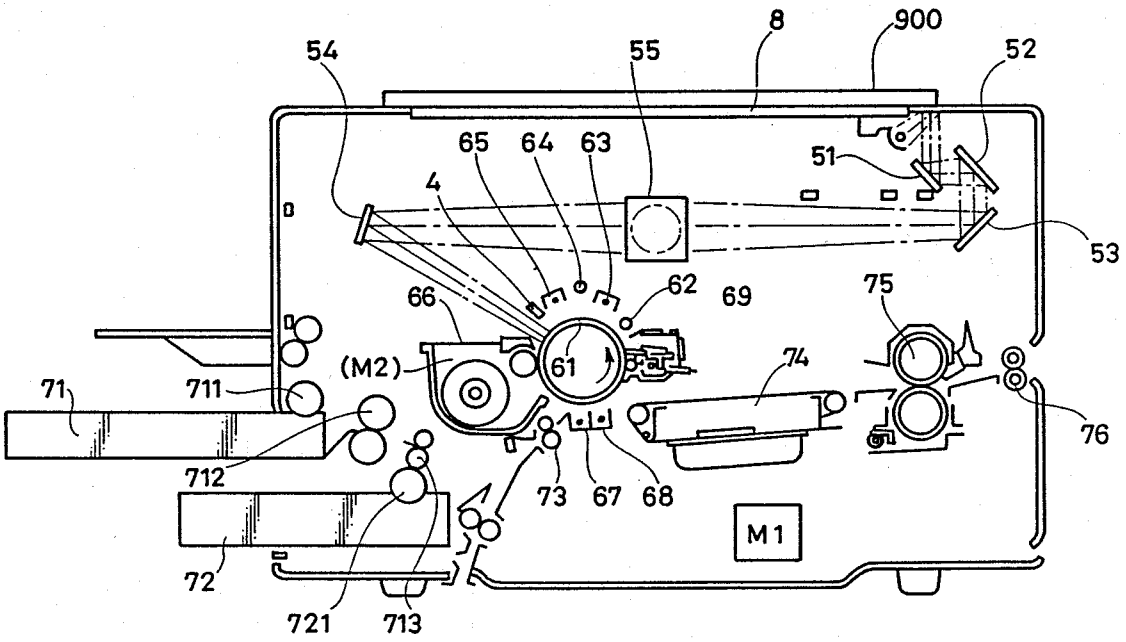
FIG. 1 is a typical view showing a construction of a copying machine included in a copying apparatus in accordance with the present invention.

FIG. 1 is a typical view showing a construction of a copying machine included in a copying apparatus of the embodiment.

As shown in FIG. 1, the copying machine comprises a scanning system 5 including components 51 to 55 for scanning a document and transmitting an image thereof, an image forming portion 6 including components 61 to 69 for reproducing the transmitted image on copy paper by an electrophotographic process, a paper feed and discharge system 7 including components 71 to 76 and 711 to 721 for feeding copy paper and fixing the image thereon, and a document table 8 of glass.

In the above described copying machine, light reflected from a document irradiated by a light source L is reflected on mirrors 51 to 54 an passed through a lens 55, so that a light image is formed on a surface of a photoreceptor drum 61.

The photoreceptor drum 61 has the surface on which a photosensitive layer is formed. The photosensitive layer is charged when it passes along eraser lamps 62 and 64, and corona chargers 63 and 65. As a result, an electrostatic latent image is formed corresponding to the above mentioned light image. The electrostatic latent image is not formed in an area where electric charge is removed by an erasure unit 4 to be described afterwards. The electrostatic latent image thus formed is subjected to development in a developing device 66 so that toner adheres thereto. The adhered toner is transferred onto a copy paper (fed through timing rollers 73 of the paper feed and discharge system 7) by means of a transfer charger 67. After the transfer, the copy paper is separated from the surface of the photoreceptor drum 61 by discharge of a copy paper separation charger 68. The copy paper is transported to a fixing device 75 by means of a transport belt 74 and after the toner image has been fixed by the fixing device 75, the copy paper is discharged to discharge rollers 76.

Figure 2:
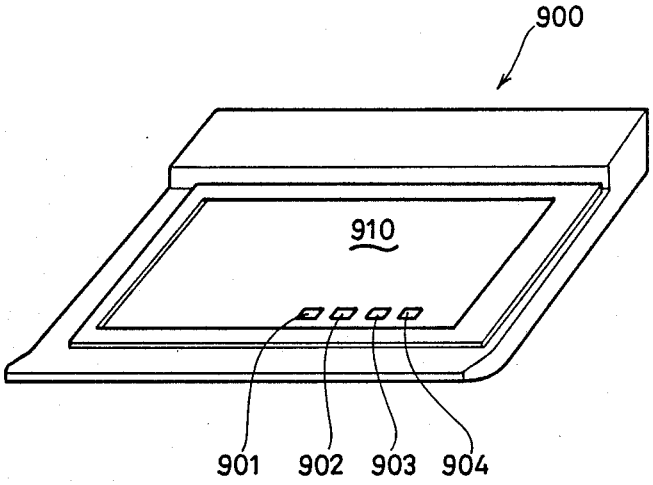
FIG. 2 is a perspective view of an editing input apparatus to be connected to the copying machine.

FIG. 2 is a perspective view showing an editing input apparatus (hereinafter referred to as an editor) 900 included in this embodiment. The editor 900 is placed for example on the document table 8 of the above described copying machine, so that the editor 900 is connected with the copying machine.

As shown, the editor 900 comprises a tablet 910 and keys 901 to 904.

The tablet 910 has a number of transparent rsistance wires provided at intervals of about 1 mm in an x-axis direction and in a y-axis direction. When an arbitrary point on the tablet 910 is pressed to short-circuit the related resistance wires, x and y coordinates of the point are detected. The detection of the x and y coordinates of the arbitrary point is made by detecting a resistance value determined by the x and y coordinates, based on a voltage level. Therefore, in order to input a specified point of a document, the document is properly positioned on the tablet 910 add then the specified point is pressed. Thus, the x and y coordinates of the specified point are inputted.

The keys 901 to 904 are an erase key 901, a trimming key 902, an end key 903 and a clear key 904.

The erase key 901 is a key for designating erasure of a specified area. The trimming key 902 is a key for designating erasure outside a specified area. Each of those keys 901 and 902 is used to input an edit mode.

The end key 903 is a key for completing input of coordinates and input through the erase key 901 and the trimming key 902. Thus, when the end key 903 is turned on, the edit mode is set in the copying machine.

The clear key 904 is a key for canceling the above described inputs of coordinates and the edit mode.

Figure 3:
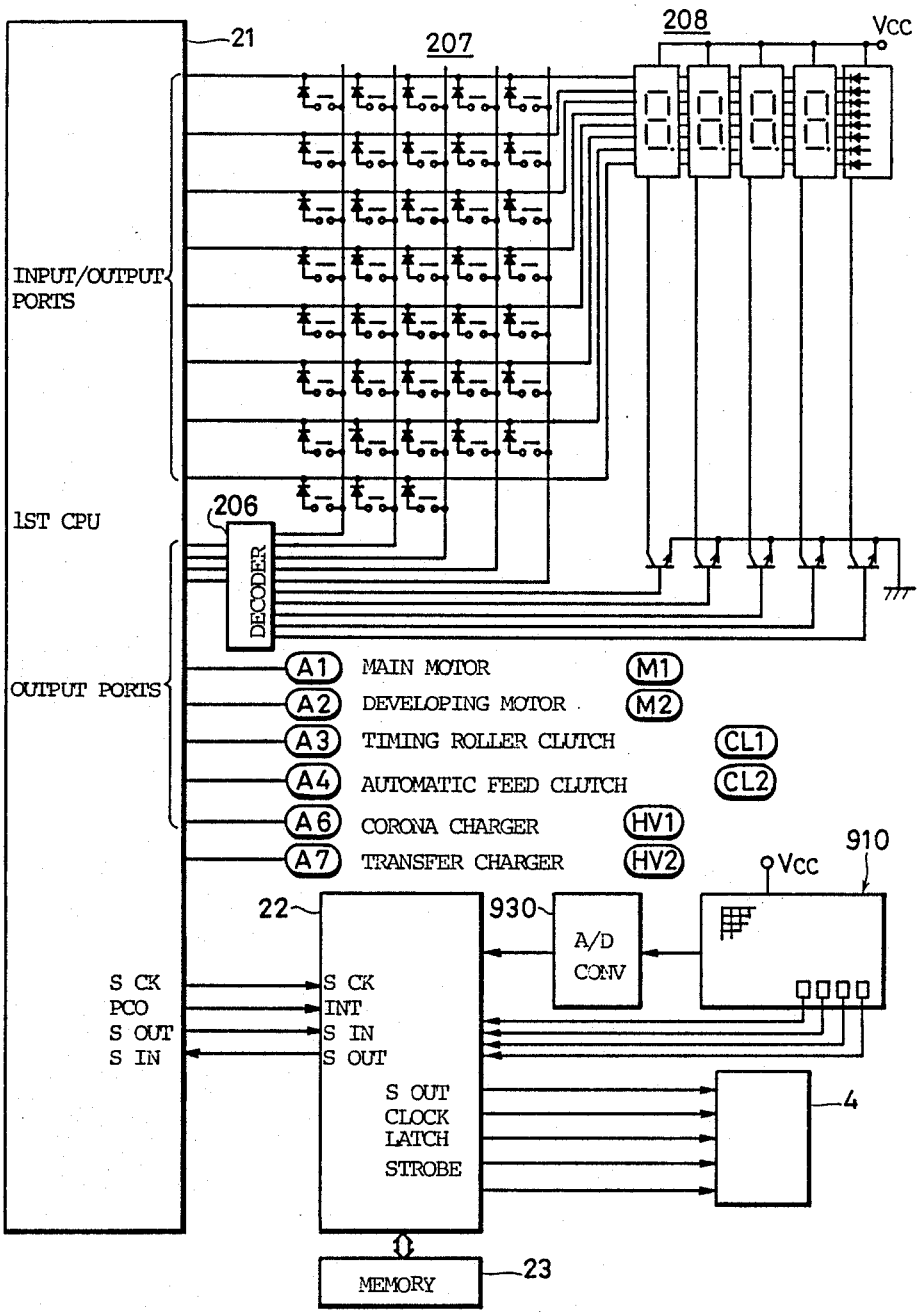
FIG. 3 is a diagram showing input and output relations between a first CPU for main control of the copying machine and a second CPU for control of an editing input apparatus.

FIG. 3 is a diagram for explaining input and output connections between a first CPU 21 for main control of the copying machine and a second CPU 22 for control of the editor 900 and an erasure unit 4.

As shown in FIG. 3, the first CPU 21 is connected to a key group 207 and a display portion 208 through a decoder 206. The first CPU 21 is also connected to drivers such as a main motor M1, a developing motor M2, a clutch of the timing rollers 73, an automatic feed clutch, the corona charger 65 and the transfer charger 67.

The first CPU 21 controls main operation of the copying machine such as driving of the image forming portion 6 and the paper feed and discharge system 7, or temperature adjustment, in response to input through keys or sensors.

The second CPU 22 controls input of coordinate data from the tablet 910 through an A/D converter 930. It also controls input through the keys 901 to 904. The second CPU 22 is connected to a memory 23 through a bus line so that data is communicated therebetween. Coordinate data and edit mode data inputted from the editor 900 are stored in the memory 23.

The second CPU 22 controls individual emission of light of LED devices of the erasure unit 4 in response to an instructin from the first CPU 21. This control is performed based on the coordinate data and the edit mode data stored in the memory 23 in response to an input signal of the end key 903 from the editor 900.

Figure 4:
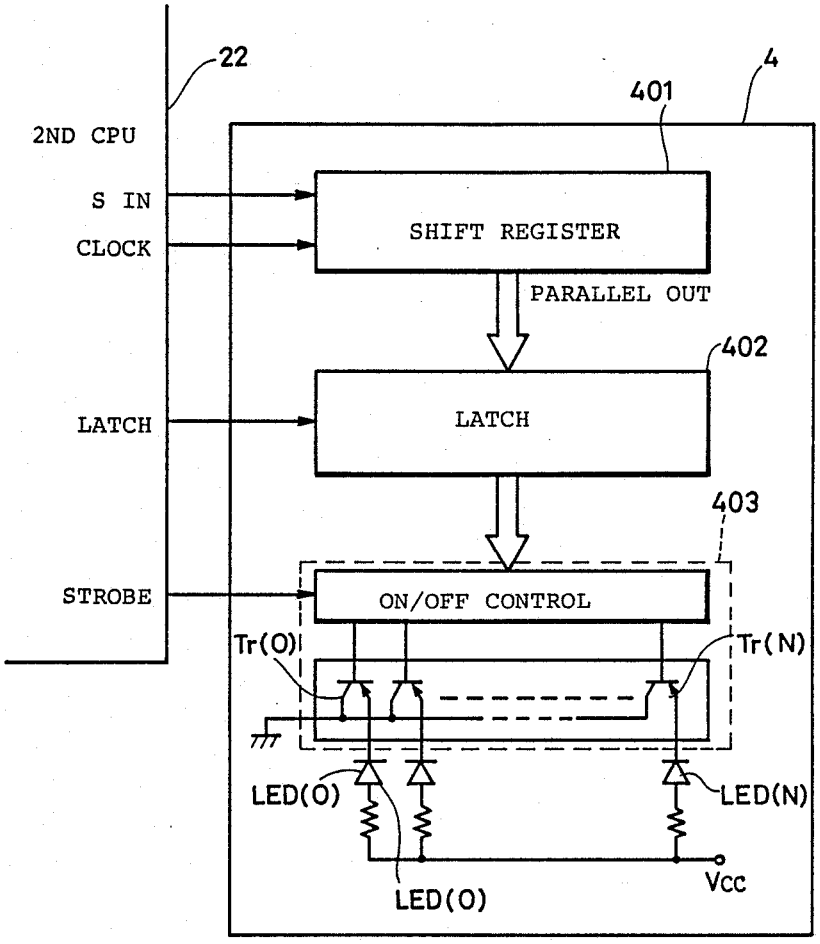
FIG. 4 is a diagram of a control circuit of the erasure unit.

FIG. 4 is a diagram showing a drive control circuit for the erasure unit 4.

As shown, the drive control circuit comprises a shift resistor 401, a latch 402 and a driver 403. Those components 401 to 403 are controlled based on a signal transmitted from the second CPU 22 so as to control turn-on and turn-off of drive transistors Tr(O) to Tr(N).

The respective LED devices LED(O) to LED(N) are driven by power supply voltage Vcc.

Figure 5:
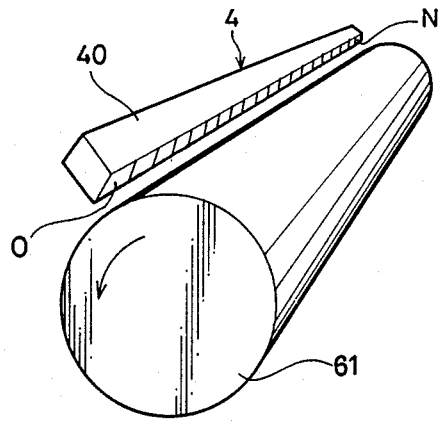
FIG. 5 is a perspective view of the erasure unit.
Figure 6:
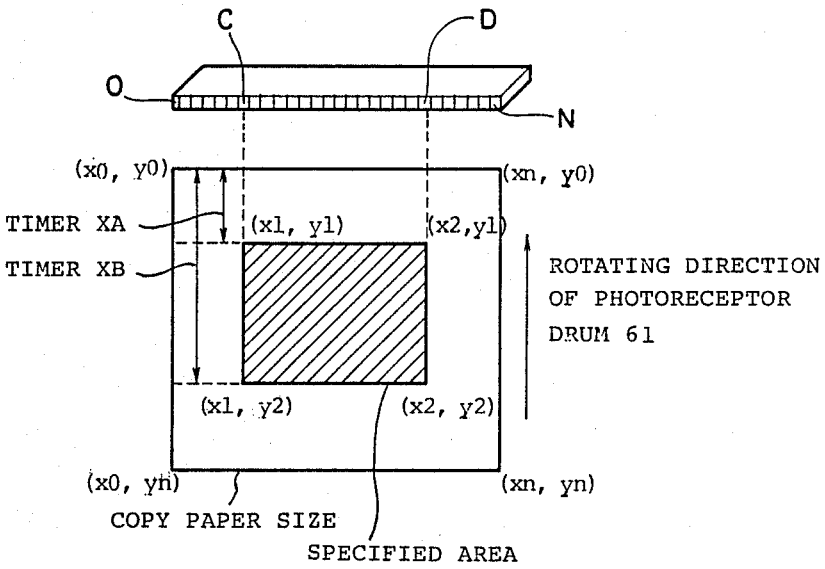
FIG. 6 is an illustration for explaining erasure of electric charge on a specified area.

FIG. 5 is a perspective view of the erasure unit 4 disposed close to the photoreceptor drum 61. FIG. 6 is an illustration for showing a state in which electric charge on a specifie area is erased by the erasure unit 4.

As shown in FIG. 5, the erasure unit 4 comprises an LED array 40 including a number of (N+1) LED devices in a line. When arbitrary LED devices are selectively enabled to emit light, electric charge on an area of the photoreceptor drum 61 corresponding thereto is removed. Thus, formation of an electrostatic latent image on that area can be prevented.

For example, as shown in FIG. 6, the (N+1) LED devices are denoted by characters 0 to N starting from the left. If the LED devices denoted by C to D are turned on in a period from an end of a timer XA to an end of a timer XB, electric charge on an area of the photoreceptor drum 61 corresponding to the hatched portion in the figure is removed. As a result, an electrostatic latent image is not formed in that area. Accordingly, a copy image corresponding to that area is not transferred.

Figure 7:
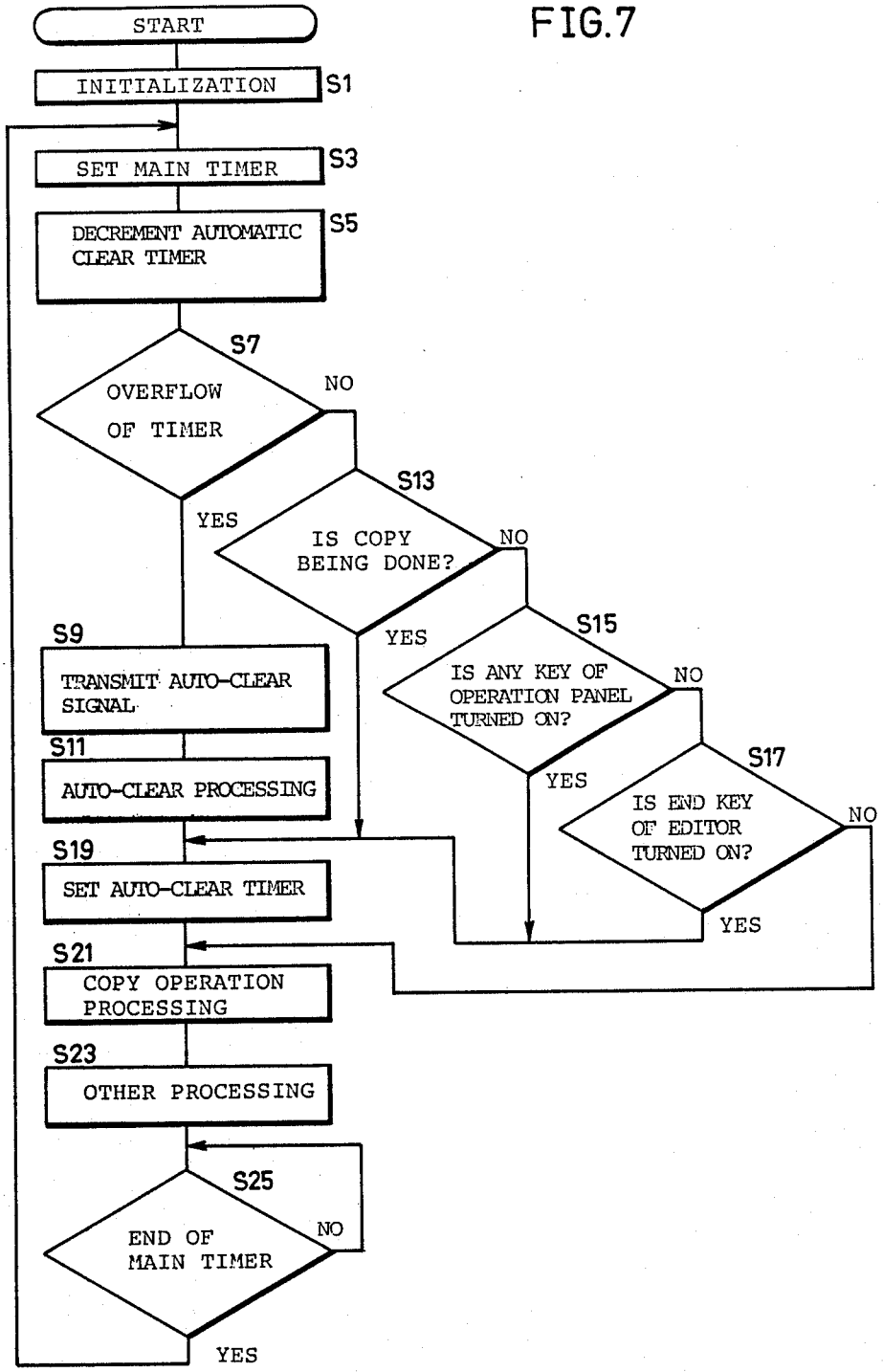
FIG. 7 is a flow chart showing processing performed by the first CPU.

FIG. 7 is a flow chart showing an outline of processing in the first CPU 21. When power supply is turned on, the first CPU 21 starts processing. First, initialization is effected (in the step Sl). More specifically, various registers and an auto-clear timer to be described afterwards are initialized. The copying machine is set to a standard mode (having a equal scale of copying magnification for example). Then, a main timer for defining a period of one routine is started (in the step S3). An end of the auto-clear timer is determined dependent on the number of times one routine defined by the main timer is counted.

In the step S5, a counter for the auto-clear timer is decremented for one routine. When the count value of the counter for the auto-clear timer becomes zero (which means an overflow), an auto-clear signal is transmitted to the second CPU 22 (in the step S9). Then, auto-clear processing is performed, that is, the copying machine is reset to the predetermined initial state (in the step Sll). On the other hand, if the count value of the counter for the auto-clear timer is 1 or more, and if copy operation is not being effected (in the step Sl3), it is determined whether any of key switches on a well-known operation panel in the copying machine is operated or not (in the step S15). If any of the key switches is not operated, it is determined whether the end key 903 of the editor 900 is operated or not (in the step Sl7).

In the step S19, the counter for the auto-clear timer is set. Subsequently, copy operation processing (in the step S21) and other processing (in the step S23) are performed and at an end of the main timer, the processing flow returns to the step 33. Thus, the loop is executed repeatedly.

The above mentioned copy operation processing (in the step S21) is well-known and therefore description thereof is omitted. The above mentioned other processing (in the step S23) includes processing such as input and output of data and instruction signals or other communication.

Figures 8, 10:
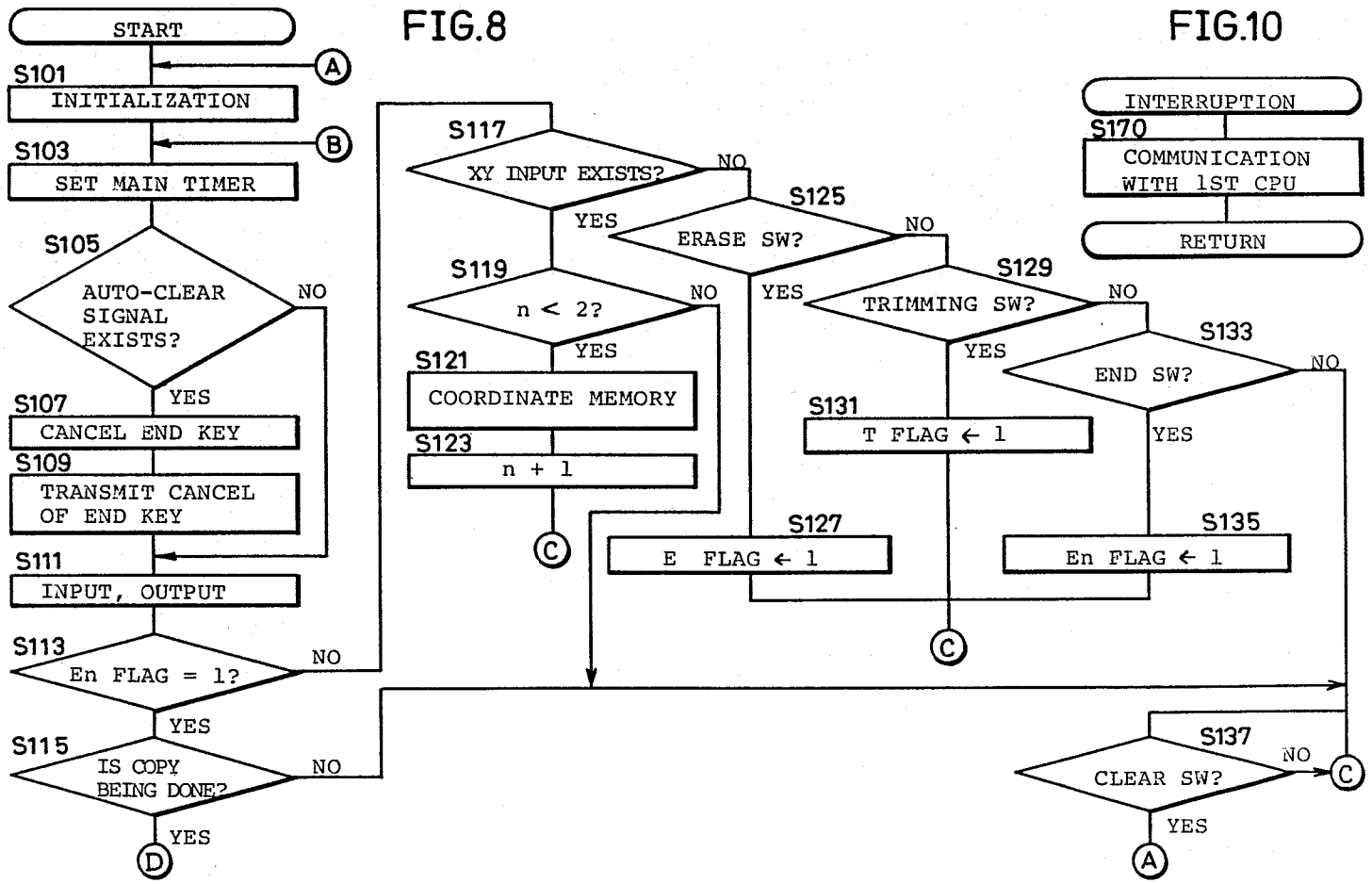
FIGS. 8, 9 and 10 are flow charts showing processing performed by the second CPU.
Figure 9:
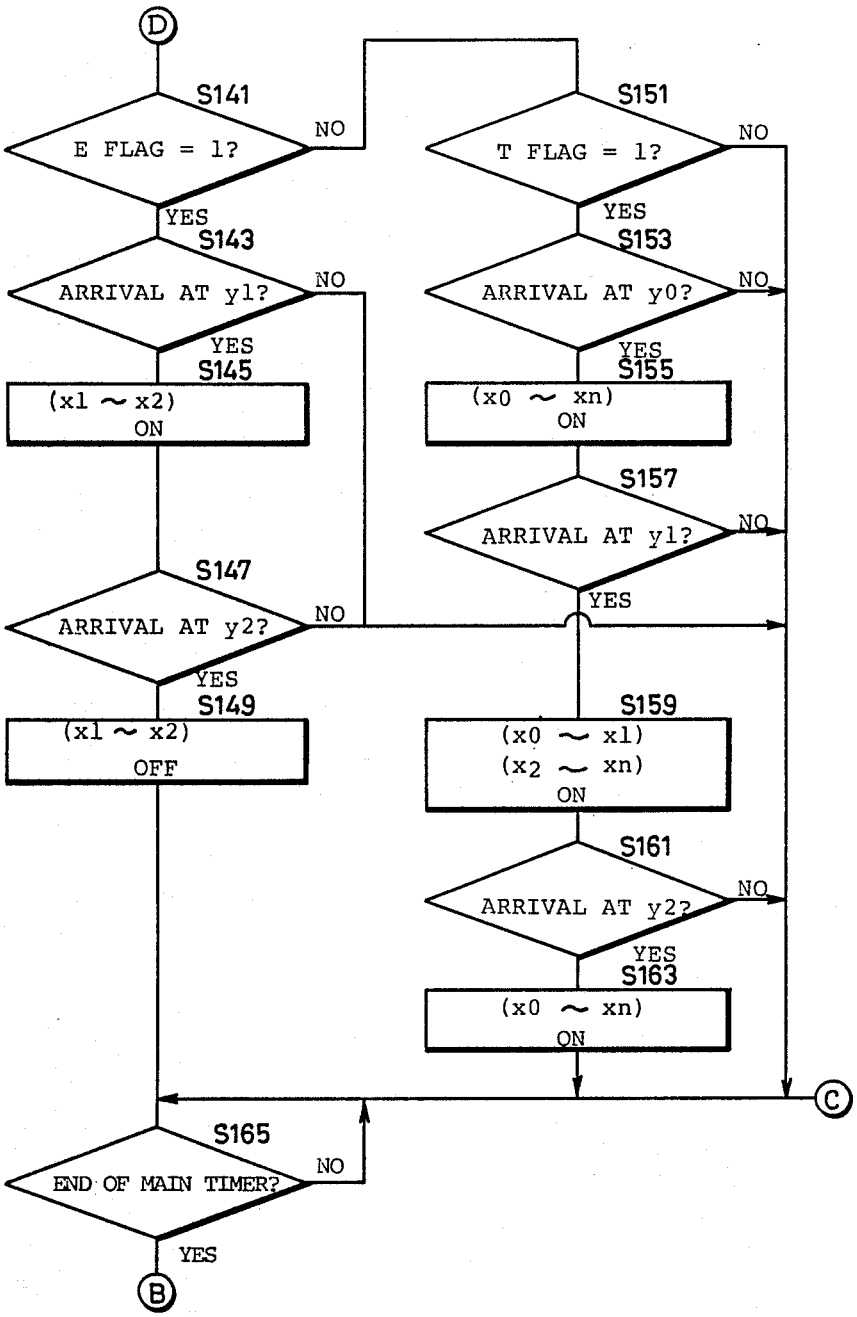

FIGS. 8, 9 and 10 are flow charts showing processing in the second CPU 22.

As shown, the second CPU 22 starts processing when the power supply is turned on for example. First, initialization is effected (in the step S101). For example, a predetermindd area of the memory 23 is cleared. Various flags and input data such as coordinate data and edit mode data are cleared. Subsequently, the main timer for defining a period of one routine is started (in the step S103).

In the step S105, it is determined whether or not the auto-clear signal is outputted from the first CPU 21. If the auto-clear signal is received, the input through the end key 903 is canceled (in the step S107). Thus, a flag En to be described afterwards is reset to 0. As a result, the edit mode is canceled. The canceled state of the end key 903 is transmitted to the first CPU 21 (in the step S109). Then, the second CPU 22 proceeds to the step S111 to activate input and output portions, so that input through the keys and the like is accepted.

In the step S113, it is determined whether the flag En (i.e., the end flag) is set or not. A state of the flag En is inputted by the editor 900. If the flag En is set, this means that the edit mode is selected to perform editing copy based on the coordinate data and other data stored in the memory 23.

In the step S115, it is determined whether or not copy operation is being effected in the copying machine. This determination is made based on a signal outputted from the first CPU 21. If it is determined in the step Sll5 that copy operation is being effected in the copying machine, the flow proceeds to the step S141. If copy operation is not being effected, the processing flow proceeds to the step S137. If it is determined in the step S113 that the flag En is not set, it is determined in the step S117 whether or not an electric signal is inputted from the tablet 910. This determination is made dependent on change of data inputted from the tablet 910 through the A/D convertor 930. If it is determined in the step S117 that the electric signal is inputted, the processing flow proceeds to the step S119 to determine whether the number n of pressing operations on the tablet 910 (that is, the number of coordinate input operations) attains 2. If the number n of pressing operations attains 2, the processing flow proceeds to the step S137. On the other hand, if the number n of pressing operations does not attain 2, the processing flow proceeds to the step S121. After the electric signal generated by pressing operation on the tablet 910 has been stored in the memory 23 as coordinate data, the value n is incremented by one (in the step S123) and then the processing flow proceeds to the step S165. In the present embodiment, an area to be erased or trimmed is assumed to be a rectangular area and accordingly it is only necessary to input coordinate data by two pressing operations. Consequently, the upper limit value of n is 2 in the present embodiment.

In the step S125, it is determined whether the erase key 901 is operated or not. If it is determined that the erase key 901 is operated, a flag E (i.e., an erase flag) is set (in the step S127) and the processing flow proceeds to the step S165. In the step S129, it is determined whether the trimming key 902 is operated or not. If it is determined that the trimming key 902 is operated, a flag T (i.e., a trimming flag) is set (in the step S131) and the processing flow proceeds to the step S165. The trimming key 902 is not operated, the processing flow proceeds to the step S133.

In the step S133, it is determined whether the end key 903 is operated or not. If the end key 903 is operated, the flag En is set and the processing flow proceeds to the step S105. When the end key 903 is operated, the second CPU 22 outputs a notification signal to the first CPU 21. On the other hand, if the end key 903 is not operated, the processing flow proceeds to the step S137.

In the step S137, it is determined whether the clear key 904 is operated or not. If the clear key 904 is not operated, the processing flow returns to the step S165. If the clear key 904 is operated, the processing flow returns to the step S101.

The steps S141 to S149 are related with control for erasure of a specified area. More specifically, as shown in FIG. 6, the LED devices (shown by C to D) corresponding to the x-coordinates x1 to x2 are turned on in a period corresponding to the y-coordinate from $y=y1$ to $y=y2$ (controlled by a timer) based on the coordinate data and the like stored in the memory 23. As a result, the electric charge within the rectangular area having the coordinates (x1, y1) and (x2, y2) as vertexes of the diagonals is fully erased.

On the other hand, the steps S151 to S163 are steps for trimming a specified area. More specifically, as shown in FIG. 6, when the y-coordinate attains $y=y0$, the LED devices corresponding to x1 to x2 are turned off in a period corresponding to the y-coordinates from y1 to y2 and the LED devices corresponding to the other coordinates are turned on. As a result, the electric charge outside the rectangular area having the coordinates (x1, y1) and (x2, y2) as the vertexes of the diagonals is fully erased.

Then, in the step S165, the second CPU 22 waits for an end of the main timer. After that, the processing flow returns to the step S103.

As shown in FIG. 10, the second CPU 22 communicates with the first CPU 21 when an interruption is issued from the first CPU 21 (in the step S170).

In the above described embodiment, if the auto-clear processing (in the step S11) is performed in the copying machine, the coordinate data and the edit mode data stored in the memory 23 are not cleared. In other words, the auto-clear processing is only performed to reset the flag En of the second CPU 22 to 0.

When the end key 903 is pressed once more, editing copy can be restarted.

Consequently, for example, during coordinate input operation in the editor 900, already inputted coordinate data is not reset to a non-inputted state as a result of auto-clear processing in the copying machine. In addition, when the end key 903 is thus pressed, the auto-clear timer is newly set (in the step S19). Accordingly, the input of the edit mode data is never canceled due to the operation of the end key 903 even if auto-clear processing is performed immediately after the operation of the end key 903.

In order to further facilitate use of the editor 900, the editor 900 may be provided with a display portion for indicating that the edit mode data is stored, that is, the end key 903 is in the input state.

As described in the foregoing, the copying apparatus in accordance with the present invention comprises input means for inputting data for specifying a desired area of a document, storing means for storing input data, copy means for copying an image of an arbitrary area of the document on copy paper, control means for controlling the copy means based on data stored in the storing means, mode designation means for designating a mode for operating the control means, data of the designated mode being stored in the storing means, auto-clear means for generating an auto-clear signal, and mode cancel means for canceling the designated mode by the auto-clear means.

Since the copying apparatus is thus constructed, if the auto-clear signal is generated, the signal is only applied to cancel the designation of the mode, while the data of the specified desired area and the data of the designated mode are maintained in the storing means.

As a result, in the copying apparatus in accordance with the present invention, input of data on coordinates for edition and data on the edit mode can be prevented from being canceled.

Although the present invention has been described and illustrate in detail, it is clearly understood that the same is by way of illustration add example only and is not to be taken by way of limitation, the scope of the present invention being limited only by the terms of the appended claims.

What is claimed is:

1. A copying apparatus comprising:
input means for inputting data for specifying a desired area of a document,
storing means for storing input data,
copy means for copying an image of an arbitrary area of the document on copy paper,
control means for controlling said copy means based on data stored in said storing means,
mode designation means for designating a mode for operating said control means, data of the designated mode being stored in said storing means,
clear signal generating means for generating a auto-clear signal for initializing said copy means, and
cancel means responsive to said clear signal for cancelling the mode designated by said mode designation means, whereby only said designated mode is canceled when said clear signal is generated, and said data for specifying the desired area and said data of the designated mode are maintained in said storing means.

2. A copying apparatus in accordance with claim 1, wherein said clear signal generating means generates said clear signal after a lapse of a predetermined period from an end of copying operation by said copy means.

3. A copying apparatus in accordance with claim 1, wherein said clear signal generating means generates said clear signal after a lapse of a predetermined period from an end of designation of the mode by said mode designation means.

* * * * *

UNITED STATES PATENT AND TRADEMARK OFFICE

CERTIFICATE OF CORRECTION

PATENT NO. : 4,794,424

DATED : December 27, 1988

INVENTOR(S) : HIGAKI et al

It is certified that error appears in the above-identified patent and that said Letters Patent is hereby corrected as shown below:

Claim 1, line 12, "auto-" should be deleted.

Signed and Sealed this

Eighteenth Day of July, 1989

*Attest:*

DONALD J. QUIGG

*Attesting Officer*

*Commissioner of Patents and Trademarks*